US005679932A

United States Patent [19]

Kim

[11] Patent Number: 5,679,932

[45] Date of Patent: Oct. 21, 1997

[54] GROUP MANAGEMENT CONTROL METHOD FOR ELEVATOR SYSTEM EMPLOYING TRAFFIC FLOW ESTIMATION BY FUZZY LOGIC USING VARIABLE VALUE PREFERENCES AND DECISIONAL PRIORITIES

[75] Inventor: Jeong O. Kim, Kyungsangnam-Do, Rep. of Korea

[73] Assignee: LG Industrial Systems Co., Ltd., Seoul, Rep. of Korea

[21] Appl. No.: 380,508

[22] Filed: Jan. 30, 1995

[30] Foreign Application Priority Data

Feb. 8, 1994 [KR] Rep. of Korea ..... 2459/1994

[51] Int. Cl.[6] ..... B66B 1/18

[52] U.S. Cl. ..... 187/382; 187/392; 187/387

[58] Field of Search ..... 187/392, 387, 187/382, 380

[56] References Cited

U.S. PATENT DOCUMENTS

| | | | |
|---|---|---|---|
| 5,022,498 | 6/1991 | Sasaki et al. | 187/127 |
| 5,229,559 | 7/1993 | Siikonen et al. . | |
| 5,239,142 | 8/1993 | Ekholm et al. . | |
| 5,243,155 | 9/1993 | Sirag Jr. | 187/127 |
| 5,248,860 | 9/1993 | Sirag, Jr. . | |
| 5,252,789 | 10/1993 | Sirag, Jr. et al. . | |
| 5,260,526 | 11/1993 | Sirag, Jr. . | |
| 5,260,527 | 11/1993 | Sirag, Jr. . | |
| 5,272,288 | 12/1993 | Kameli | 187/127 |
| 5,274,202 | 12/1993 | Kezer et al. | 187/125 |
| 5,276,295 | 1/1994 | Kameli . | |
| 5,305,198 | 4/1994 | Schroder et al. | 364/402 |
| 5,307,903 | 5/1994 | Morita et al. | 187/124 |
| 5,329,076 | 7/1994 | Kameli | 187/127 |
| 5,511,635 | 4/1996 | Kameli | 187/392 |

FOREIGN PATENT DOCUMENTS

| | | |
|---|---|---|
| 3-102082 | 4/1991 | Japan . |
| 3172291 | 7/1991 | Japan . |
| 4226285 | 8/1992 | Japan . |
| 4-246076 | 9/1992 | Japan . |
| 5-132250 | 5/1993 | Japan . |

*Primary Examiner*—Robert Nappi
*Attorney, Agent, or Firm*—Oliff & Berridge

[57] ABSTRACT

An improved group management control method for an elevator capable of efficiently performing a group management control of an elevator based upon the building condition by deciding a corresponding car to be allocated in accordance with a predetermined hall call based upon a traffic flow and the fuzzy theory which are differ from the characteristics of each building, which includes the steps of a traffic flow collecting step for collecting information concerning a current traffic flow occurred at each hall call and car; a traffic flow study step for studying information collected at the traffic flow collecting step; a traffic flow anticipating step for anticipating a traffic flow after a predetermined time based upon the information studied at the traffic flow study step; a specific mode judgement step for judging a specific mode corresponding to the traffic flow anticipated at the traffic anticipating step; an allocation control strategy establishment step for establishing control strategy for allocating a proper car based upon a specific mode judged at the specific mode judgement step and the information and role defined by building manager; a comprehensive evaluation function operation step for operating a comprehensive evaluation function for each car when a hall call occurs; an allocation possible car selection step for selecting a predetermined car possible for a hall call based upon the comprehensive evaluation function operated at the comprehensive evaluation function operation step; a control item value operation step for operating an input value per control item for an allocated possible car selected at the allocation possible car selection step; and an allocated car decision step for deciding a car based upon a predetermined estimated rule using an input value per control item operated at the control item value operation step.

5 Claims, 9 Drawing Sheets

| |
|---|
| IF THE TOTAL TRAFFIC FLOW AMOUNT IS SMALL, THE SPECIFIC MODE IS A LIGHT TRAFFIC MODE. |
| IF THE TOTAL TRAFFIC FLOW, THE CONCENTRATED TRAFFIC FLOW, AND THE DISTRIBUTED GETTING-OFF TRAFFIC FLOW ARE LARGE THE SPECIFIC MODE IS A GOING-TO-OFFICE TRAFFIC MODE. |
| IF THE TOTAL TRAFFIC FLOW IS MID-LEVEL, THE DISTRIBUTED GETTING-ON TRAFFIC IS LARGE, AND THE DISTRIBUTED GETTING-OFF IS LARGE, THE SPECIFIC MODE IS USUAL TRAFFIC MODE. |
| IF THE TOTAL ON-BOARD TRAFFIC FLOW IS LARGE, THE DISTRIBUTED GETTING-ON TRAFFIC IS LARGE, AND THE CONCENTRATED GETTING-OFF TRAFFIC IS SMALL, THE SPECIFIC MODE IS A BEFORE-LUNCH TIME TRAFFIC MODE. |
| IF THE TOTAL ON-BOARD TRAFFIC FLOW IS LARGE, THE CONCENTRATED GETTING-ON TRAFFIC IS LARGE, AND THE DISTRIBUTED GETTING-OFF TRAFFIC IS LARGE, THE SPECIFIC MODE IS AN AFTER-LUNCH TIME TRAFFIC MODE. |
| IF THE TOTAL ON-BOARD TRAFFIC FLOW, THE DISTRIBUTED ON-BOARD TRAFFIC, AND THE CONCENTRATED GETTING-OFF TRAFFIC IS LARGE, THE SPECIFIC MODE IS A GOING-OUT-OFFICE TRAFFIC MODE |
| IF THE TOTAL TRAFFIC FLOW IS LARGE, THE CONCENTRATED GETTING-OFF IS LARGE, AND THE CONCENTRATED GETTING-OFF TRAFFIC IS LARGE, THE SPECIFIC MODE IS A HEAVY TRAFFIC MODE. |
| IF THE TOTAL ON-BOARD TRAFFIC FLOW IS LARGE, THE CONCENTRATED ON-BOARD TRAFFIC IS LARGE, AND THE CONCENTRATED GETTING-OFF LARGE, THE SPECIFIC MODE IS A SPECIFIC FLOOR HEAVY TRAFFIC MODE. |

FIG.8

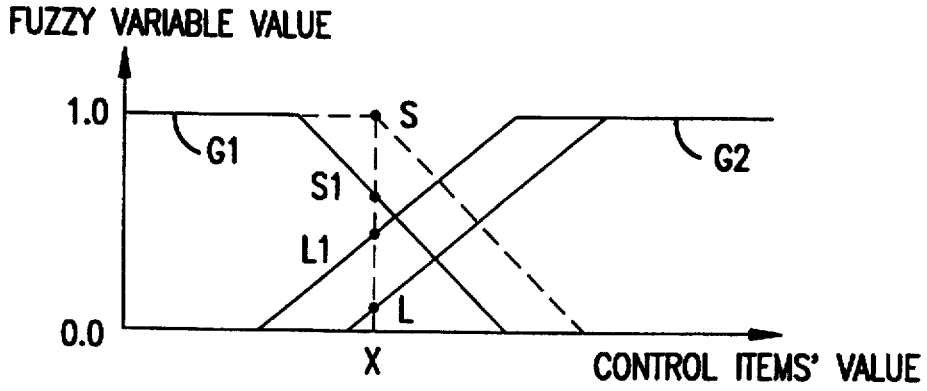

FIG.11

| |
|---|
| SHIFT A FUZZY FUNCTION TO THE LEFT IF THE PRIORITY OF A HALL CALL WAITING TIME IS LARGE. |
| SHIFT A FUZZY FUNCTION TO THE LEFT IF THE PRIORITY OF A HALL CALL MAXIMUM WAITING TIME IS LARGE. |
| SHIFT A FUZZY FUNCTION TO THE RIGHT IF THE PRIORITY OF ON-BOARD POSSIBLE CAPACITY IS LARGE. |
| SHIFT A FUZZY FUNCTION TO THE RIGHT IF THE PRIORITY OF TRAFFIC FLOW MANAGEMENT CAPACITY IS LARGE. |
| SHIFT A FUZZY FUNCTION TO THE RIGHT IF THE PRIORITY OF AN ALLOCATION CONCENTRATION IS LARGE. |
| SHIFT A FUZZY FUNCTION TO THE LEFT IF THE PRIORITY OF A LOAD CONCENTRATION IS LARGE. |

FIG.12

| |
|---|
| STEP 1; IF THERE IS A CAR WHICH SATISFIES A UPPER PRIORITY VALUE AND IN WHICH A LOWER PRIORITY VALUE IS NOT SO BAD, IT IS SELECTED. |
| STEP 2; IF THERE IS A CAR WHICH USUALLY SATISFIES A UPPER PRIORITY VALUE AND IN WHICH A LOWER PRIORITY VALUE IS NOT SO BAD, IT IS SELECTED. |

HEREINAFTER OMITTED

FIG.13

GROUP MANAGEMENT CONTROL METHOD FOR ELEVATOR SYSTEM EMPLOYING TRAFFIC FLOW ESTIMATION BY FUZZY LOGIC USING VARIABLE VALUE PREFERENCES AND DECISIONAL PRIORITIES

BACKGROUND OF THE INVENTION

1. Field of the Invention

The present invention relates to a group management control method for an elevator system, and particularly to an improved group management control method for an elevator system capable of efficiently performing a group management control of an elevator system based upon the building condition by deciding a corresponding car to be allocated in accordance with a predetermined hall call based upon a traffic flow and the fuzzy theory which differ per the characteristics of each building.

2. Description of the Conventional Art

Conventionally, a group management control method for an elevator system refers to generally controlling the operation of an elevator system under a predetermined control condition. The major objectives thereof are to reduce waiting time at each floor, enhance anticipated call ratio, maximize elevator's capacity per car, and advantageously decrease electrical power consumption.

Here, the anticipated call ratio is defined as a ratio between an actually operating corresponding car operation in accordance with a hall call after a predetermined hall call at a predetermined floor and the anticipation thereof.

In addition, the hall call is defined as a call of calling a predetermined car at a predetermined floor, and a car call is defined as to push a predetermined button in the elevator for getting off at a desired floor.

In order to satisfy the above conditions, the function of the group management control method for the elevator system generally consists of a hall call allocation function, a distribution control function, a display control function, and an adaptation control function based upon the changes of the traffic condition.

In the hall allocation function, one method of anticipating a possible traffic flow is used based upon statistical data of the past and current traffic information. Here, the traffic flow is defined as a distribution of passengers who get off and/or get on the car at every floor. The more accurate anticipation of the traffic flow is subject to the conditions of the building, whereby the elevator may not be properly managed thereby.

In addition, even though proper statistical values are decided for the best performance of the elevator, the proper management of the elevator can not be achieved due to the abrupt traffic jam and the abruptly increasing traffic flows. In order to cope with the above-mentioned problems, the elevator control system should be designed in consideration of the conditions and characteristics of the building, thereby achieving the proper operation of the elevator system against the changing traffic flow.

However, at present a new system using so called artificial intelligence based upon the fuzzy theory is used therefor, thereby resolving the hard-to-resolve problems which occur due to the control method based upon the statistical data.

A conventional group management control for an elevator, as shown in FIG. 1, includes a hall call registration device 10 for registering a hall call by users, a car control device 20 for controlling the driving of each car of the elevator system, a traffic state information input device 30 for outputting the traffic state information T1 by processing the traffic signal IN outputted from the hall call registration device 10 and the car call control device 20, a group management control device 50 for outputting the elevator control information CO by receiving the traffic state information TI, and a group management control signal output device 40 for outputting the group management control signal OUT to the hall call registration device 10 and the car control device 20.

The group management control device 50, as shown in FIG. 2, includes a central processing unit 51, a hall call allocation control device 52 for controlling a hall call allocation function, and an input/output control device 53 for enabling interfacing with the traffic state information input device 30 and the group management control signal output device 40.

The operation of the conventional group management control method for the elevator system will now be explained.

The major function among the functions of deciding which car is allocated to the hall call is the so-called hall call allocation control function which decides a predetermined one of cars which are in the ready state.

To begin with, in the traffic flow anticipation step S1, the traffic state information TI outputted from the traffic state information input device 30 is inputted into the input/output control device 53 of the group management control unit 50.

The traffic state information TI, for example, contains traffic flow amount data indicating the number of passenger per unit hour in each car, location and moving direction of cars, the number of on-board passengers in each car, the number of car calls registered and hall calls registratered, and a current control performance statistic P.

Here, the control performance statistic P indicates a passenger's average waiting time, a passenger's maximum waiting time, a registration change ratio of the car calls, and the running number of each car.

Here, the average waiting time refers to the average value of a passenger's waiting time to arrive at a predetermined floor, in which a hall call occurred, the passenger's maximum waiting time refers to the maximum value of the passenger's waiting time, and the registration change ratio of the car hall refers to the ratio between the registered car calls and a car call which is newly registered.

When the traffic information TI is inputted, the current traffic flow obtained by the previously stored traffic flow and the traffic information TI is exponentially smoothed by the exponential smoothing value, whereby the possible traffic flow is anticipated. That is, the anticipated traffic flow may obtained by the following equation.

$$LT1=(1-\beta)*Told+\beta*Tnew \quad (1)$$

In equation (1) LT1 is the anticipated traffic flow, Told is the previously stored traffic flow, Tnew is the current traffic flow obtained as the traffic state information TI, and $\beta$ is the exponential smoothing value.

Thereafter, in the control performance anticipation step S2, a control constant number in accordance with the anticipated traffic flow is decided by the simulation. Here, the control constant number is referred to a ratio reflected per evaluation item computed for evaluating the performance of each car and has different values based upon the running strategy.

The method of deciding the control constant number using simulation will now be explained in detail.

To begin with, a predetermined traffic flow is decided to test the performance of the group management control for the elevator, and the control constant number adapted to the previously set traffic flow is defined, and then the group management is simulated, whereby the result of the running is obtained. Thereafter, the constant number is changed and then the group management running is again simulated using the changed constant number, whereby a predetermined constant number at the best running performance is obtained through repeated simulations, and thus the constant number is used in the actual group management control.

In the comprehensive evaluation function operation step S3, the comprehensive evaluation function Θ(e) is operated based upon the traffic information TI and the above described control constant number. Here, the comprehensive evaluation function θ(e) refers to a function of evaluating the evaluation items by each car in order to decide which car is to be allocated for a hall call occurring at a predetermined floor and may be expressed as below.

$$E=\text{Min}\ \{\Theta(e)\} \tag{2}$$

$$\Theta(e)=\{A+(kb*B)+(kc*C)+\ \ldots\ \}-(kx*X)+(ky*Y) \tag{3}$$

In equations (2) and (3) E is the minimum value of the comprehensive evaluation function, Min is the minimum value, Θ(e) is the comprehensive evaluation function for each car, A is the passenger's possible waking time for a hall call, B is the statistic of the full car at the floor where a hall call occurred, C is the statistic of the passenger's longest waiting time when allocating hall calls, X is the stop concentration, Y is the state evaluation function of the elevator, and kb, kc, kx, ky are the constant numbers of each evaluation item.

That is, the comprehensive evaluation function Θ(e) is computed in accordance with the above evaluation items A, B, C, X, Y per car and each evaluation item reflection ratios kb, kc, kx, ky. Here, the stop concentration X refers to an evaluation value for the distance between floors where hall calls occur and if the stop concentration is increased, the running number of the elevators is decreased, thereby reducing the electrical power consumption.

In the car allocation decision step S4, a decided car corresponding to a minimum value of the comprehensive evaluation function Θ(e), and the elevator control information CO is outputted to the group management output device 40 in order to control the decided car.

The elevator control information CO transmitted to the group management control signal output device 40 from the group management control unit 50, for example, contains elevator door closing/opening command, command of distributing each car, hall call allocation signal, and control signals for various display devices.

However, according to the conventional group management control method for the elevator system, since the control performance anticipation means is decided by an operation of the repeated simulation, it is impossible to control the traffic flow in real time. In addition, as using the algorithm of the comprehensive evaluation function directly, the changes of the traffic flow has a different distribution with a statistical model previously defined, so that the optimization of the control constant number is actually impossible for the group management traffic flow. That is, the conventional group management control method for the elevator is disadvantageously restricted to cope with the wide range use of the traffic flow based upon the characteristics of the building by using the optimization method of the control constant number.

SUMMARY OF THE INVENTION

Accordingly, it is an object of the present invention to provide a group management control method for an elevator.

It is another object of the present invention to provide an improved group management control method for an elevator capable of efficiently performing a group management control of an elevator based upon building equipped with elevators by deciding a corresponding car to be allocated in accordance with a predetermined hall call based upon a traffic flow and the fuzzy theory which are differ from the characteristics of each building.

To achieve the above objects, there is provided an improved group management control method for an elevator, which includes the steps of a traffic flow collecting step for collecting information concerning a current traffic flow occurred at each hall call and car; a traffic flow study step for studying information collected at the traffic flow collecting step; a traffic flow anticipating step for anticipating a traffic flow after a predetermined time based upon the information studied at the traffic flow study step; a specific mode judgement step for judging a specific mode corresponding to the traffic flow anticipated at the traffic anticipating step; an allocation control strategy establishment step for establishing control strategy for allocating a proper car based upon a specific mode judged at the specific mode judgement step and the information and rule defined by building manager; a comprehensive evaluation function operation step for operating a comprehensive evaluation function for each car when a hall call occurs; an allocation possible car selection step for selecting a predetermined car possible for a hall call based upon the comprehensive evaluation function operated at the comprehensive evaluation function operation step; a control item value operation step for operating an input value per control item for an allocated possible car selected at the allocation possible car selection step; and an allocated car decision step for deciding a car based upon a predetermined estimated role using an input value per control item operated at the control item value operation step.

BRIEF DESCRIPTION OF THE DRAWINGS

FIG. 8 is a description table showing a fuzzy theory rule for a specific mode judgement of FIG. 6 according to the present invention.

FIG. 11 is a graph showing a fuzzy function adjusting method of FIG. 9 according to the present invention.

FIG. 12 is a view showing a regulating rule adapted to a corresponding function adjusting method of FIG. 11 according to the present invention.

FIG. 13 is a view showing a allocation rule stored in an allocation information data base.

DETAILED DESCRIPTION OF THE INVENTION

To begin with, whether the current state is a traffic flow period or not is judged (Step 00). If the judged state is the traffic flow period, the step 10 is performed.

In the step 10, the current traffic flow is computed based upon the traffic state information CO inputted thereto every one minute and five minutes.

Here, the traffic flow collected at every 5 minutes is obtained by accumulating each traffic flow amount obtained every one minute and computing an average of the accumulated traffic flow amount.

Among the traffic state information CO, the major information used in the allocation for hall calls is regarding the number of the getting-on and getting-off persons at each floor, a traffic flow amount in the upward direction, a traffic flow amount in the downward direction, complexity, current time, running performance, and direction and location of each car.

In a step S20, the current traffic flow amount collected at the step S10 and the past traffic flow amount obtained for the same time as for the current time and stored in the study data base are smoothly stored in the traffic flow study data base TDB. Thereafter, the traffic flow for the same time as for the current time in the traffic flow study data base TDB is updated, whereby the study on the current traffic flow is performed.

The traffic flow obtained every hour is different, however the characteristics of the traffic flow per hour are periodically repeated. Therefore, if the traffic flow is studied as the method described above, we can obtain a predetermined characteristic as the operation of the elevator is performed day by day, so that the proper traffic flow can be estimated using the above characteristics.

Figure 1:
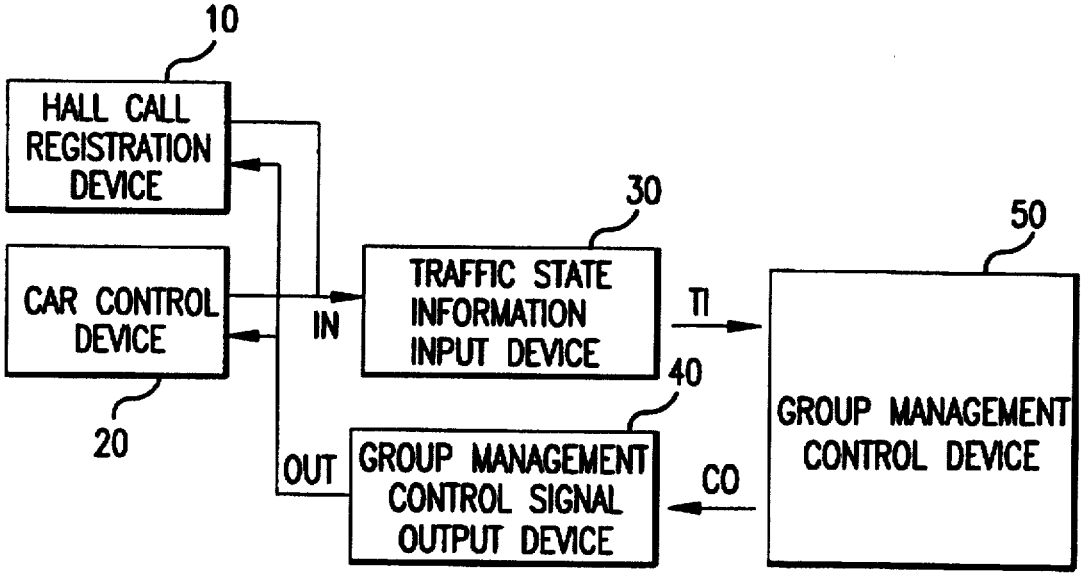
FIG.1 PRIOR ART
FIG. 1 is a block diagram showing a conventional group management control apparatus of an elevator.
Figure 2:
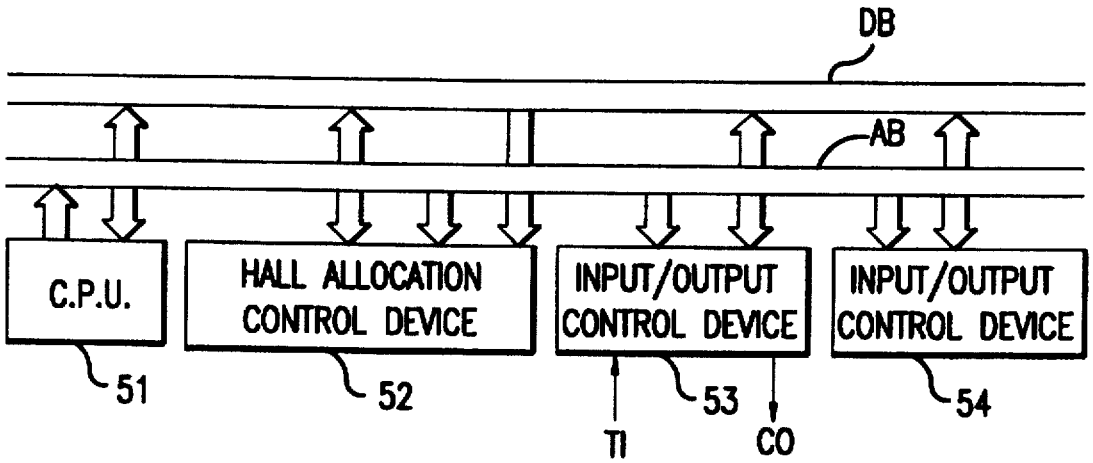
FIG.2 PRIOR ART
FIG. 2 is a block diagram showing a group management control means of FIG. 1 according to the conventional art.
Figure 3:
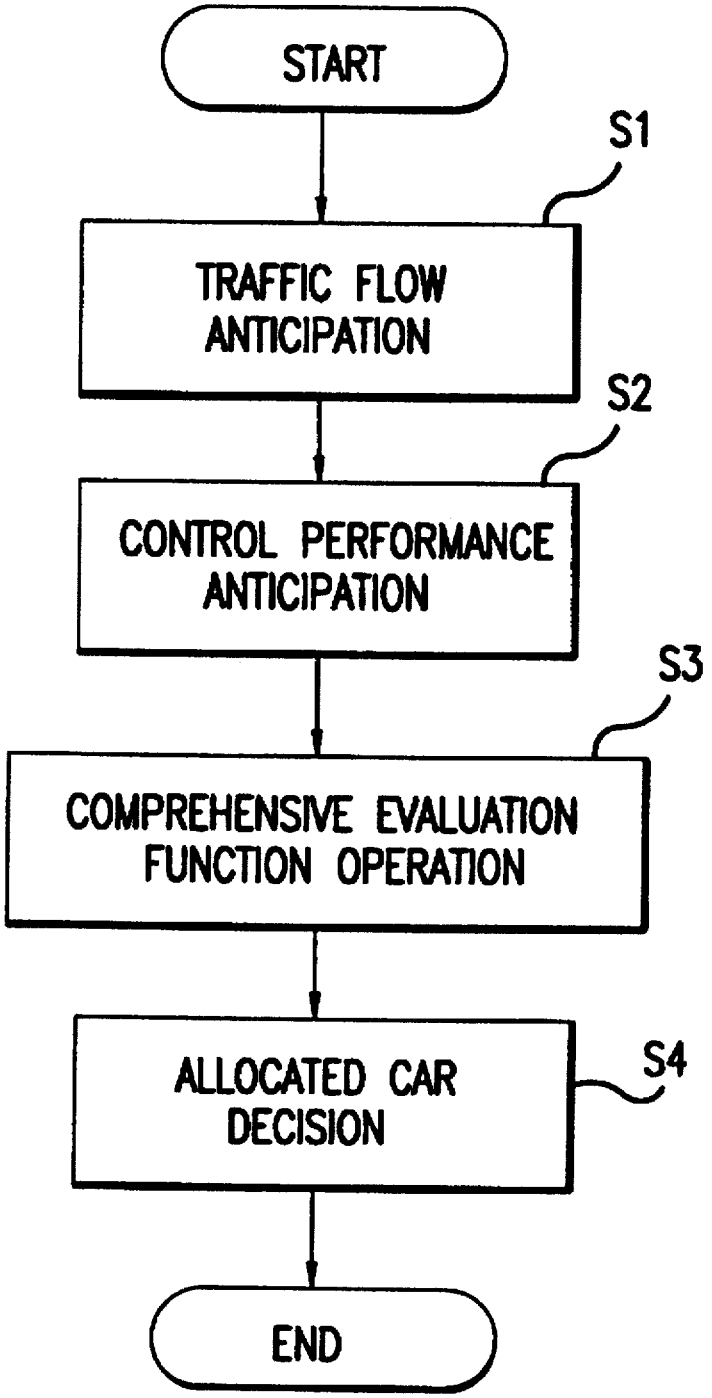
FIG. 3 is a flow chart showing a hall call allocation control method of a hall call allocation control means of FIG. 2 according to the conventional art.
Figure 4:
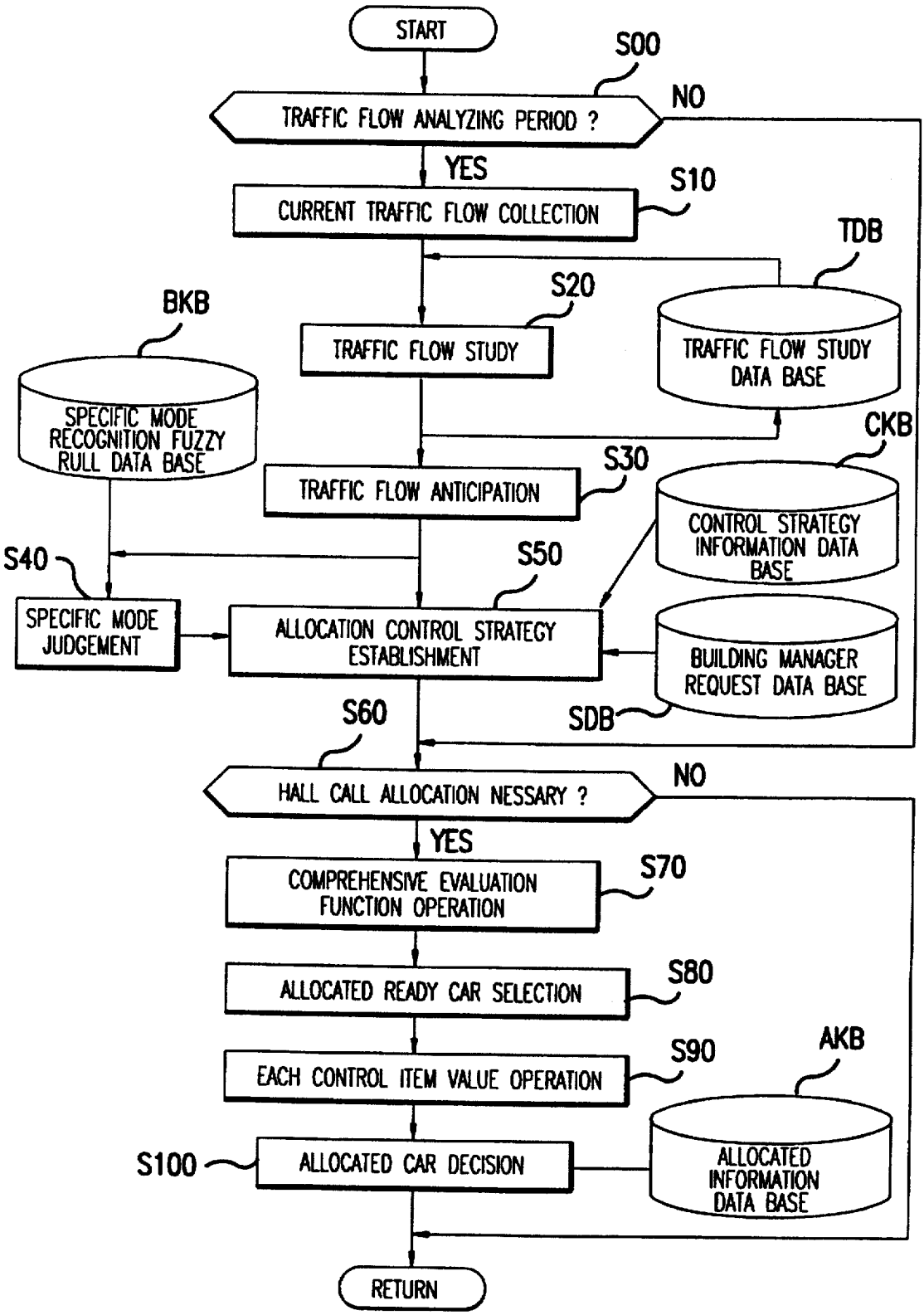
FIG. 4 is a flow chart showing a group management control method for an elevator according to the present invention.
Figure 5A:
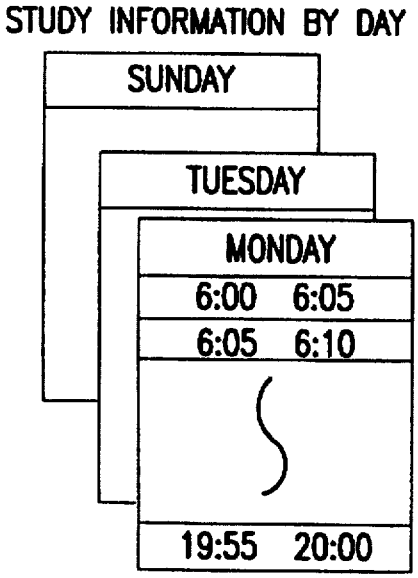
FIGS. 5A and 5B are views showing a construction of data stored in a traffic flow study data base of FIG. 4 according to the present invention.
Figure 5B:
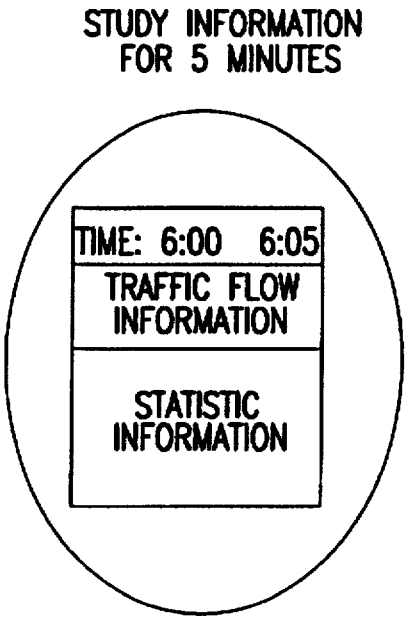

The information regarding the traffic flow stored in the traffic flow study data base TDB, as shown in FIG. 5A, is the information obtained through the studies performed every day and consists of the information studied every 5 minutes. In addition, the information obtained through 5 minutes study, as shown in FIG. 5B, consists of the information of the traffic flow and the statistical information.

The information regarding the above traffic flow refers to the number of the getting-on and getting-off persons at each car and floor and consists of the average waiting time of passengers, the long time waiting statistic of passengers, the number of runnings of each car, and time of closing/opening the door of the elevators.

In a step S30, the traffic flow after one minute is obtained based upon the information regarding the current traffic flow studied at the step S20. Here, the function of correctly estimating the possible traffic flow becomes a major function for deciding the group management control of the elevator.

Figure 6:
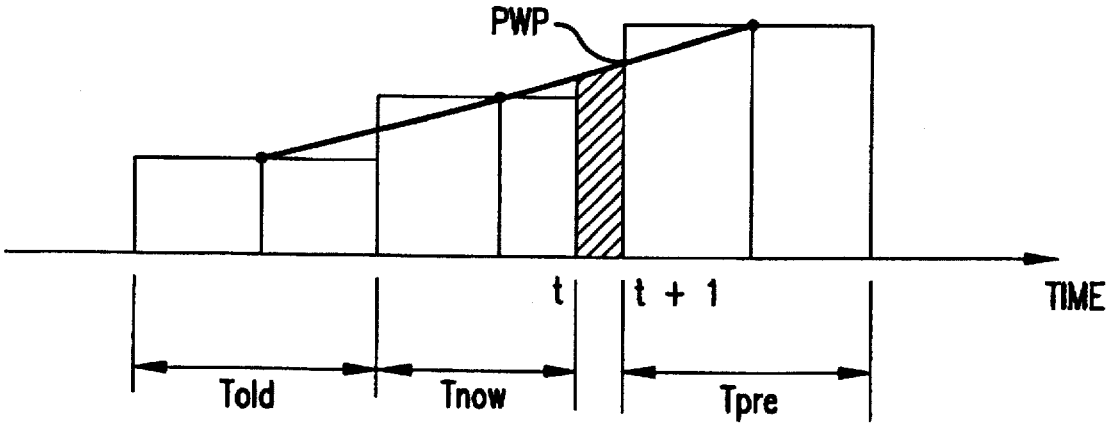
FIG. 6 is a graph showing a computation method of an anticipated traffic flow of FIGS. 5A and 5B according to the present invention.

The method of anticipating the traffic flow after one minute will now be explained with reference to FIG. 6, based upon the current traffic flow collected at the step 10 and the traffic flow amount previously stored in the traffic flow study data base every five minutes at the step S20.

The traffic flow stored after five minutes may be expressed the following equation.

$$Tpre=(1-\alpha)*Told+\alpha*Tnow \quad (4)$$

In equation (4) Tnow is the current traffic flow, Told is the past traffic flow at the time of the anticipated traffic flow Tpre, and α is the ratio between the past traffic flow Tpre and the current traffic flow Tnow, having a predetermined value between 0 and 1 and varies by a predetermined algorithm.

The traffic flow PWP for anticipating a predetermined time from the current time t to the time t+1 is obtained in accordance with the information Tpre of the traffic flow. Therefore, the hatched shaded are in FIG. 6 refers to the traffic flow PWP anticipated after 1 minute.

In a step S40, the specific mode of the traffic flow corresponding to the traffic flow PWP anticipated at the step S30 is judged in accordance with the fuzzy rule stored in the specific mode recognition fuzzy rule data base BKB.

Here, the specific mode of the traffic flow refers to a predetermined mode for defining the traffic flow, as having various kinds of the traffic flows.

The steps of judging the specific mode of the traffic flow will now be explained.

Generally, the basic characteristic of the traffic flows obtained for one day may be classified into the following three kinds.

The first has a characteristic consisting of a specific floor concentration getting-on and a usual floor distribution for gettings-off which usually appear during the going-to-office and after-lunch times.

The second, it has a characteristic consisting of a usual floor distribution gettings-on and a specific floor concentration gettings-off which usually appear during the going-out-of-office and the before-lunch times.

The third has a characteristic consisting of a usual floor distribution for gettings-on and a usual floor distribution for gettings-off which usually appear during the usual day time.

Based upon such characteristics, the following modes may be obtained: a light traffic mode, a going-to-office mode, a usual mode, a before-lunch mode, an after-lunch mode, a going-out-office mode, a heavy traffic mode, and a specific floor complexity mode.

Among such modes, the light traffic mode and the going-to-office modes will be explained in more detail.

The light traffic mode is characterized to have a less than total on-board amount and no concentrated gettings-on, and refers to the time of mid-night or early morning, when users of the elevator are few.

In addition, the going-to-office mode is characterized by concentrated gettings-on at a predetermined floor and the distributed gettings-off at every floor and refers to the time of going-to-office.

In order to judge the specific mode for the current traffic flow according to the conventional art, the least mean square comparison method was usually used. Therein, the vicinity level of the traffic flow per the current traffic flow and a specific mode which is previously defined are computed, whereby a specific mode of the current traffic flow is judged by the vicinity level.

However, if a predetermined traffic flow corresponding to a corresponding mode is previously defined, since there are problems not to properly control the elevator in accordance with the traffic flows having various characteristics subject to the building, the present invention adapted the fuzzy theory of using the specific mode recognition rule in order to judge the specific mode.

Figure 7:
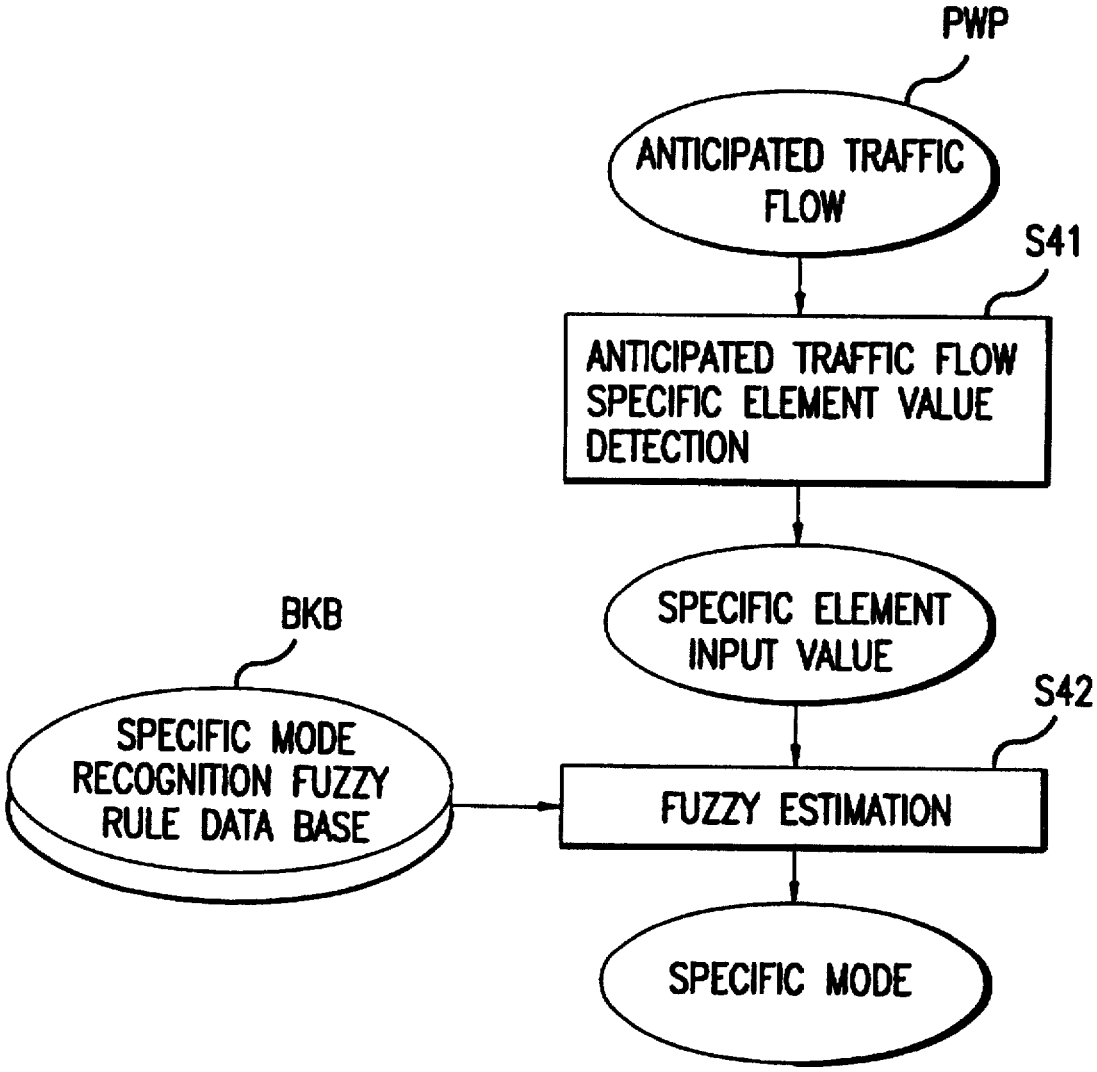
FIG. 7 is a flow chart showing a specific mode judgement method of FIG. 6 according to the present invention.

The step S40 of judging the specific mode using the fuzzy theory will now be explained with reference to FIGS. 7 and 8.

In a step S41, the traffic flow at the step S30 is inputted and the specific element value of the traffic flow PWP inputted thereto is detected. The examples of the specific element values are as follows.

- A total on-board amount: the total number of persons travelling in the upward and downward directions for one minute
- A concentration getting-on amount: the ratio between the total on-board amount and the number of the on-board persons at the complexity floor
- A concentrated getting-off amount: the ratio between the total on-board amount and the number of the getting-off persons at the getting-off complexity floor
- A distribution getting-on amount: the ratio between the total on-board amount and the number of the getting-on persons except for the number of the getting-on persons at the getting-on complexity floor
- A distribution getting-off amount: the ratio between the total on-board amount and the number of the getting-off persons except for the number of the getting-off persons at the getting-off complexity floor.
- Current time
- A specific mode of the past traffic flow Here, the getting-on complexity floor refers to the floor where the complexity occurs, and the getting-off complexity floor refers to the floor where the complexity occurs.

In a step S42, the fuzzy estimation method is directed to estimate a specific mode corresponding to the anticipated traffic flow using the specific element value detected at the step S42 and the fuzzy rules stored in the specific mode recognition fuzzy rule data base BKB.

The fuzzy estimation method is well known to the skilled person, so the description thereof is omitted. The estimation method based upon the fuzzy estimation method and used in the present invention is referred to the mini-max estimation method by Professor Mandadi, E. H.

One example of the fuzzy theory stored in the specific mode recognition fuzzy rule base BKB is described in FIG. 8. The specific mode having the highest satisfaction level is decided as the specific mode corresponding to the anticipated traffic flow PWP.

In a step S50, the allocation control strategy is set up in order to allocate a proper car, based upon the anticipated traffic flow PWP, the specific mode decided at the step S42, the building manager request data base SDB and the control strategy information establishment data base CKB.

The step S50 for establishing the allocation control strategy will now be explained with reference to FIGS. 9 to 13.

Figure 9:
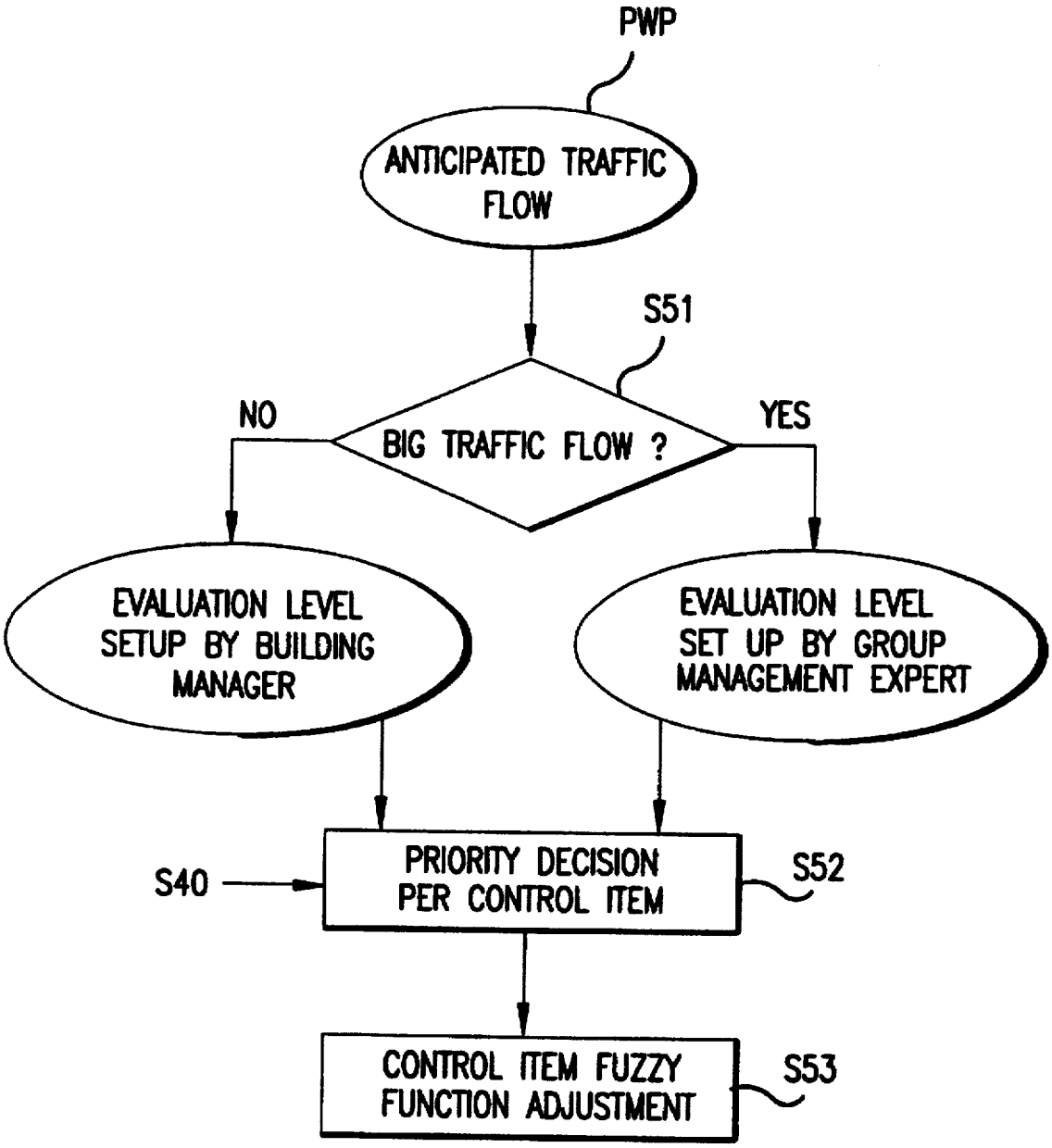
FIG. 9 is a flow chart showing a method of establishing an allocation control strategy of FIGS. 5A and 5B according to the present invention.

Referring to FIG. 9, in the step S51, the complexity of the traffic flow PWP anticipated at the step S30 is judged. In addition, if the complexity judged therein is low, the evaluation level priority set up by the building manager is adapted therein, and if the complexity level is high, the evaluation level priority set up by the group management expert is adapted therein. Here, the evaluation level refers to the level used to evaluate the performance of the group management control method for the elevator. The examples and conditions which each evaluation level must satisfy will now be explained.

- The average waiting time of passengers should be short.
- The long time waiting statistic of passengers should be low.
- The electrical power consumption should be low.
- The average getting-on/-off time of passengers should be short.
- The forecast accuracy should be high.
- The complexity level should be low.

Here, the long waiting time of passengers refers to over one minute, the average getting-on/-off time of passengers is refers to time taken for getting-on/-off a predetermined car at a predetermined floor. Here, the ideal elevator control mode denotes to satisfy such conditions, however, since there exist combined or opposite conditions therein, actually all the conditions of the evaluation levels can not be satisfied.

Therefore, according to the usage of the building, the priority per evaluation level should be discriminated by the building manager because the performance of the group management control for the elevator is subject to the usage of the building.

For example, in case of the office building, the average waiting time of passengers, the long time waiting statistic of passengers, and the average getting-on/-off time of passengers should be evaluated as more important factors. In case of the hotel building, the electrical power consumption, the forecast accuracy ratio, and the complexity should be emphasized as more important factors.

The information regarding the running plan of the elevator including the evaluation level priority information defined by the building manager and the information regarding the floor should be stored into the building manager request data base SDB.

In a step S52, the priority is decided based upon the priority of the evaluation in accordance with the judgement of the step S51 and the specific mode judged at the step S40.

Such items includes the hall call waiting time, the maximum hall call waiting time, the getting-on possible traffic amount, the traffic flow amount processing capacity, the car concentration level, and the load concentration, where the hall call waiting time denotes time taken from a predetermined floor to a predetermined floor in which a hall call occurs; the maximum hall call waiting time denotes the maximum time during hall call waiting; the getting-on possible traffic flow amount denotes the number of passengers getting on a predetermined car where the car arrives at a predetermined floor where a hall call occurs, and here the number is computed by subtracting the number of actually getting-on passengers from the maximum capacity and; the allocated concentration level denotes a level in which a predetermined hall call is concentrated to a predetermined direction in the same direction as allocated for each car. Here, if the allocated concentration level is high, the waiting time of passengers at each floor is shortened, whereby the failure statistic becomes high; and the load concentration level denotes the sum of the number of the hall calls allocated to each car. In addition, the safety distance denotes the distance from the current position to a predetermined position to reach there within a predetermined time. The service possible traffic amount denotes the sum of the getting-on possible traffic flow amount for the safety distance at each car. The anticipated getting-on traffic flow amount denotes the getting-on traffic flow amount anticipated at each floor within a predetermined time. At this time, the traffic flow amount managing capacity denotes the ratio between the service possible traffic flow amount and the getting-on possible traffic flow amount. When passengers concentrates at a predetermined floor, the hall call waiting time and the getting-on possible amount are selected as the major factors. When the specific mode is the light traffic mode, that is, when the traffic flow is light, the allocation concentration or the load concentration should be selected as the major factors in order to minimize the electrical power consumption.

As described above, the priority of the control items is differently adapted by a specific mode of the traffic flow based upon the characteristic of the building, thereby increasing the performance of the group management control for the elevator.

Figure 10:
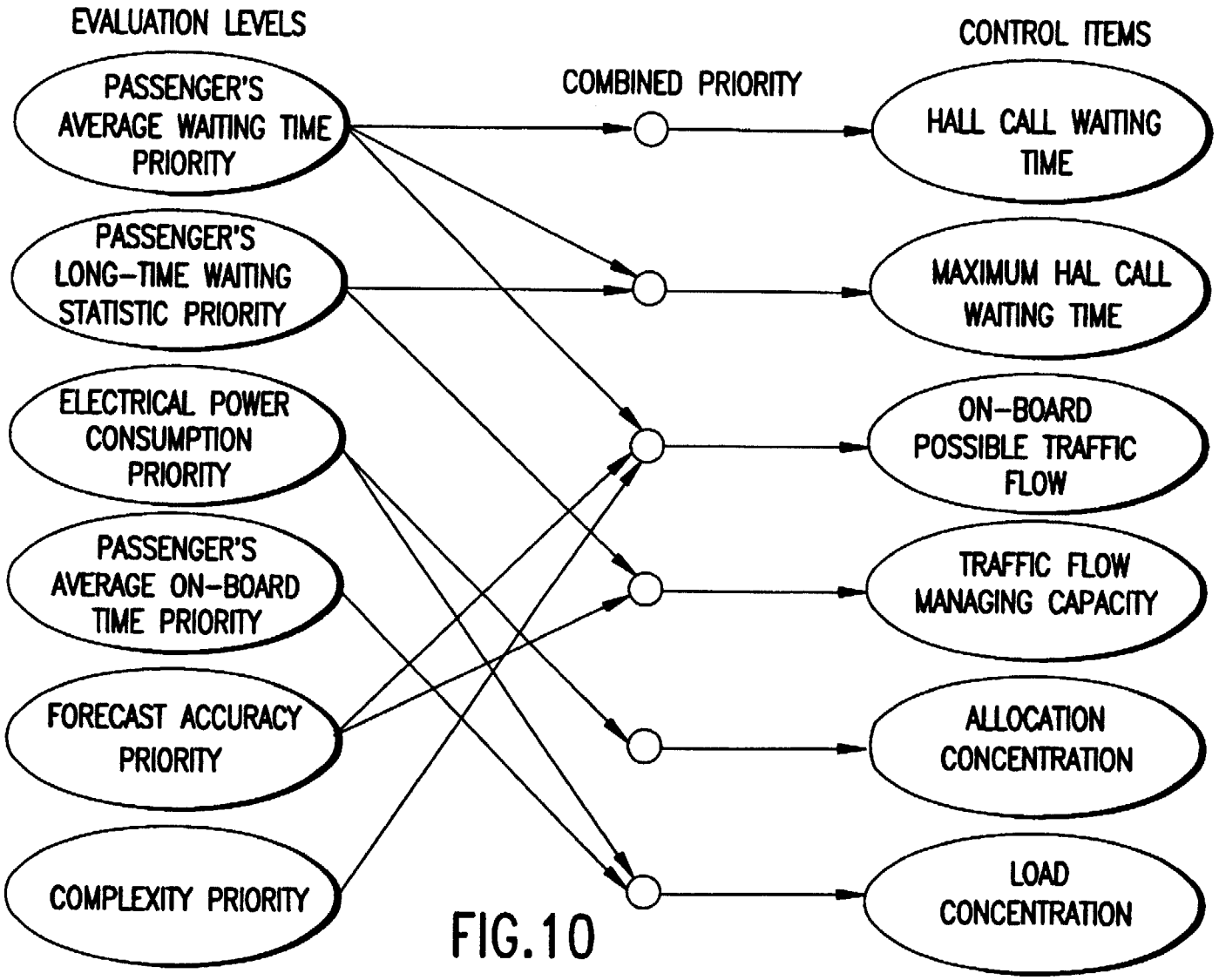
FIG. 10 is a view showing a relationship between evaluation level priorities and control items of FIG. 9 according to the present invention.

Referring to FIG. 10, the priority of each evaluation level may influence a plurality of control items, in which the combined priority of the priorities of the evaluation levels influencing each control item is the priority of the control items.

For example, the priority of the average waiting time of passengers among the evaluation levels influences the hall call waiting time among the control items, the maximum hall call waiting time, and the getting-on possible traffic amount. That is, the hall call waiting time, the maximum hall call waiting time, the getting-on possible amount should exceed a predetermined level after the hall call allocation in order that the priority of the average waiting time of passengers may reach to a predetermined level the building manager wishes.

In a step S53, the fuzzy function per control item is adjusted in accordance with the priority per control item decided at the step S52, whereby the standard for the value of the control item changes.

Here, the fuzzy function denotes a function expressing a relationship between the value of the fuzzy variables and the value of the control items, where the fuzzy variables are classified into two functions for expressing "less or greater." The fuzzy functions refer to a predetermined function G1 expressed as a "less" value and to a predetermined function G2 expressed as a "greater" value.

The adjusting method of the fuzzy function per control item will now be explained with reference to FIG. 11.

To begin with, for a predetermined control item, if the priority of the control item is increased, the fuzzy functions G1 and G2 move to the left. Thereafter, after the fuzzy function G1 is shifted thereto, the fuzzy value S1 become less than the fuzzy value S after the fuzzy function G1 is shifted. The fuzzy value L1 after the fuzzy function G2 is shifted becomes greater than the fuzzy value L1 after the fuzzy function G2 is shifted.

Therefore, the value X of the control item is increased by the value before the fuzzy functions G1 and G2 are adjusted.

For example, for the control item which is better the less the value like the hall call waiting time, if the priority thereof is greater, the fuzzy function is shifted to the left.

FIG. 12 shows an example of the rules regarding adjusting the corresponding function, and the rules are stored in the control strategy establishment information data base CKB.

In the control flow of the group management control method for the elevator system according to the present invention, the processing from the step S00 to the step 50 is periodically processed every 1 period, and is called a preparatory processing step necessary for deciding the car.

Meanwhile if, the state judged at the step S00 is not in the range of the traffic flow analyzing period, a step S60 is performed.

In the step S60, whether an allocation for a hall call is necessary is judged, and if the hall call allocation is necessary, a step S70 is performed.

In the step S70, the comprehensive evaluation function is computed.

Since the operation method of the comprehensive evaluation function is the same as in the conventional art, description thereof is omitted.

In a step S80, a plurality of allocation possible cars are selected in accordance with a comprehensive evaluation function $\Phi(e)$ per car operated at the step S70.

In the conventional group management control method for the elevator system, the comprehensive evaluation function $\Phi(e)$ is operated per car and then the car having the operated lowest value is selected. However, the group management control method for the elevator system according to the present invention selects a plurality of possible allocation cars from the result obtained from the operation of the comprehensive evaluation function.

The process of selecting the possible allocation cars may be expressed as the following equation.

$$E(k)=\mu(i)\{\Phi(e)\}. \quad (5)$$

In equation (5) E(k) is the set of cars selected as the possible allocation car, and $\mu(i)$ is the set deciding the number of cars 'i' from the given $\Phi(e)$.

Here, more than two cars having the lowest comprehensive evaluation function value are selected as possible allocation cars, and the cars having the proper maximum hall call waiting time and the value of the evaluation of the getting-on possible traffic flow amount among the remaining cars are additionally selected as possible allocation cars.

The reason of additionally selecting the possible allocation cars is for preventing any possibility of deciding the optimum allocation car in accordance with the traffic condition, even though the additionally selected car has the better comprehensive evaluation function compared with the others, if it has the best evaluation level.

In a step S90, for the possible allocation cars selected at the step S90, the input value of the control items described at the step S52 is operated. The input value of the control items are operated on the assumption that each of the cars may be selected as the possible allocated car.

In addition, the possible service traffic flow amount for the possible allocation car is computed in consideration of a new hall call and an expected car call.

In a step S100, the car to be allocated in accordance with the estimation rule stored in the allocation car information data base AKB is estimated based upon the input values per control items operated at the step S90.

However, for the optimum estimation of the car, two kinds of fuzzy input variables of the upper priority and the lower priority are used, and each of the fuzzy variables includes three kinds of classes; "good," "usual," and "bad."

The six control items are divided into a plurality of control items corresponding to the upper priority and the lower priority in accordance with the order of the priority of the control items.

In addition, the input values per control item operated at the step S90 are accumulated as the priority of the control items set up at the step S52, and the accumulated average value is estimated whether which value refers thereto, so that the satisfaction level of the upper and lower priority for all the possible allocation cars is obtained, and thus the final allocation car is decided in accordance with the satisfaction level of the upper and lower priority and the estimation rule stored in the allocation information base AKB.

Referring to FIG. 13, there is shown an example of the estimation rule stored in the allocation information base AKB. The estimation rule consists of the multiple-steps of the estimation tree structure. The optimum information structure capable of selecting the optimum car having a high priority and satisfaction level is achieved. During the multiple-steps estimation once a proper car is selected the remaining steps are not performed.

As described above, the group management control method for the elevator system has the effect of smoothly managing the group management of the elevator system in accordance with the characteristic of the building because various kinds of the requirements based upon the characteristics of the building may be accepted therein using the fuzzy theory and in the estimation of the possible car to be allocated for the hall call.

What is claimed is:

1. A group management control method for an elevator system, including the steps of collecting information concerning a current traffic flow occurring for each hall call and car of the elevator system, studying the collected traffic flow information, anticipating a traffic flow after a predetermined time based upon the studied information, and judging a specific control mode corresponding to the anticipated traffic flow, wherein the control method comprises:

an allocation control strategy establishment step for establishing a control strategy for allocating a proper car based upon selectively using one of a strategy evaluating a priority per each evaluation level set by a building manager and a strategy for evaluating a priority per each evaluation level set by a group management expert according to a complexity of an anticipated traffic flow amount;

a comprehensive evaluation function operation step for operating a comprehensive evaluation function in accordance with the established control strategy for each car when a hall call occurs;

a possible candidate cars for allocation selection step for selecting predetermined cars for possible allocation to a hall call based upon the comprehensive evaluation function operated at the comprehensive evaluation function operation step;

a control item value operation step for operating an input value per each control item for each possible allocated candidate car selected at the possible candidate cars for allocation selection step; and a car allocation decision step for deciding a car among the possible candidate cars for allocation based upon a predetermined estimating rule using the input value per each control item operated at the control item value operation step, wherein the possible candidate cars for allocation decided at said possible candidate cars for allocation selection step are cars having proper evaluation values for a maximum hall call waiting time and a getting-on possible traffic flow amount among those elevator cars having a minimum value in their respective comprehensive evaluation functions among the other elevator cars of the system, and wherein the car allocation decision step divides the control items into an upper priority group and a lower priority group in order to estimate a possible candidate car allocation, to decide a possible candidate car allocation based upon a predetermined decision rule using a satisfaction level of the upper priority and a satisfaction level of the lower priority, and decides the allocated car based upon the estimated result.

2. The method of claim 1, wherein said priority per evaluation level includes an average waiting time priority, a long time waiting rate priority, a electrical power consumption priority, an average on-board time priority, a forecast accuracy ratio priority, and a complexity priority.

3. The method of claim 1, wherein said control item includes a hall call waiting time, a maximum hall call waiting time, a getting-on possible capacity, a car concentration, and a load concentration.

4. The method of claim 1, wherein said satisfaction levels of the upper priority and lower priority are obtained by adding the input values per control items operated at the control item value operation step to the priority of the control item and producing its average value.

5. The method of claim 1, wherein said priority of the control items is obtained through being shifted to the required direction of the corresponding function per control item.

* * * * *